US005104022A

United States Patent [19]

Nakamura et al.

[11] Patent Number: 5,104,022

[45] Date of Patent: Apr. 14, 1992

[54] CONTINUOUS PAPER SHEET TEARING-UP APPARATUS

[75] Inventors: Fumihiko Nakamura; Ryohei Higashi, both of Tokyo, Japan

[73] Assignee: Toppan Moore Co., Ltd., Tokyo, Japan

[21] Appl. No.: 458,379

[22] Filed: Dec. 28, 1989

[30] Foreign Application Priority Data

| | | | |
|---|---|---|---|
| Dec. 29, 1988 | [JP] | Japan | 63-335369 |
| Dec. 29, 1988 | [JP] | Japan | 63-335370 |
| Dec. 29, 1988 | [JP] | Japan | 63-335371 |
| Feb. 1, 1989 | [JP] | Japan | 1-23264 |
| Mar. 31, 1989 | [JP] | Japan | 1-82710 |

[51] Int. Cl.[5] ..... B65H 35/10

[52] U.S. Cl. ..... 225/100; 83/365

[58] Field of Search ..... 225/100, 101, 4, 96.5; 83/370, 365

[56] References Cited

U.S. PATENT DOCUMENTS

| | | | |
|---|---|---|---|
| 4,022,364 | 5/1977 | Davis | 225/100 |
| 4,261,497 | 4/1981 | Roetter et al. | 225/100 |
| 4,269,341 | 5/1981 | Polko | 225/100 X |
| 4,397,410 | 8/1983 | Schueler | 225/100 X |
| 4,529,114 | 7/1985 | Casper et al. | 225/100 |
| 4,577,789 | 3/1986 | Hofmann et al. | 225/100 |
| 4,674,378 | 6/1987 | Kawano et al. | 83/365 X |
| 4,716,799 | 1/1988 | Hartmann | 83/365 X |

*Primary Examiner*—Mark Rosenbaum
*Assistant Examiner*—Rinaldi Rada
*Attorney, Agent, or Firm*—Wenderoth, Lind & Ponack

[57] ABSTRACT

A continuous paper sheet has a plurality of transversal perforation lines and a plurality of holes formed in the longitudinal margins of the paper sheet. The paper sheet is torn by two pairs of nipping rollers including a pair of upper and lower feed-in rollers and another pair of upper and lower pulling rollers. The pulling rollers of the latter pair rotate at a speed higher than that of the feed-in rollers so that the part of the sheet placed between the former pair of rollers and the latter pair of rollers is pulled or given tension, thus being torn and separated. After it has been confirmed the continuous paper sheet has been placed on a stand at a predetermined position, the length of the continuous paper sheet as folded is measured. The resultant measurement is compared to standard sizes previously inputted to a CPU in order to correct it to the approximate standard size. According to the corrected standard size and the sheet thickness separately measured, the tearing operation of the pairs of feed-in rollers and high speed or pulling rollers is controlled in order to give the continuous paper sheet a difference in transferring speed and to tear-off a sheet at the predetermined position of the sheet.

3 Claims, 10 Drawing Sheets

CONTINUOUS PAPER SHEET TEARING-UP APPARATUS

BACKGROUND OF THE INVENTION

The present invention relates to a continuous paper sheet tearing-off or cutting apparatus of the type provided with a pair of an upper infeed or feed-in roller and a lower infeed or feed-in roller, and another pair of an upper roller and a lower roller rotating at a rotary speed higher than that of the former pair of rollers, so that the difference between the feeding or advancing speeds of the parts of the continuous paper sheet feed through the former roller pair at a low-speed and the latter pair at a high-speed tears off the paper sheet.

According to a first kind of conventional paper tearing-off apparatus mentioned above, the continuous paper sheet is always held or nipped by a pair of an upper feed-in roller and a lower feed-in roller, and another pair of upper and lower high speed rollers. A conventional apparatus of the second kind holds or nips the continuous paper sheet only at the instant of tearing-off by means of both the pairs of rollers. According to a modification of the second conventional apparatus, the pair of the upper and lower feed-in rollers always holds the continuous paper sheet and the another pair of high speed upper and lower rollers nips the sheet only at the instant of the tearing-off operation.

The inventor has improved the conventional continuous paper tearing-off apparatus of the second kind and also the modification of the apparatus.

In general, concerning the conventional continuous paper sheet tearing-off apparatus of the second kind, it is necessary to install a paper sheet transfer apparatus, such as a tractor or the like in the apparatus and the distance between the pair of feed-in rollers and another pair of high speed rollers along the sheet transfer or feeding direction is not changed. The vertical approaching movement of the feed-in rollers and the high speed rollers in order to tear-off a sheet from the continuous paper sheet is set so as to done at the instant or moment that the size of the sheet to be torn-off corresponds to the length of the paper sheet fed through the transfer device, such as a paper drive device or the like.

Disadvantageously, in the conventional apparatus of the second kind, it is necessary to precisely control the separating operation of both the pairs of feed-in rollers and high speed rollers in accordance with the length or volume of the paper sheet fed by the transfer mechanism, and previously to precisely measure the cutting or tearing-off size of the continuous paper sheet in order to fix the timing of the separation. However, it has been difficult to precisely control the separating operation of the pair of the upper and the lower feed-in rollers and the pair of the upper and the lower high speed rollers according to the particular tearing-off size of the paper sheet. In addition, when the thickness of the continuous paper sheet changes, the gaps between the upper rollers and the lower rollers correspondingly increase or decrease, so that it has been difficult to tear-off sheets from the continuous paper sheet at the right or precise position of the sheet, even when the separation of both pairs of rollers is correctly carried out. When the tearing-off size of the sheet torn from the continuous paper sheet is measured and the sheet is set uncorrectly on the sheet measurement mechanism, it is impossible to precisely measure the tearing-off size. If the tearing-off position of the paper sheet is determined according to a wrong measurement result, no precise control of the separation of each pair of rollers is possible and it is not possible tear-off the paper sheet from a correct position.

SUMMARY OF THE INVENTION

The present invention has been accomplished to overcome the shortcomings in the conventional continuous paper sheet tearing-off apparatus of the second kind. Thus, it is the first purpose of the present invention is to provide a continuous paper sheet tearing-off apparatus for precisely measuring the tearing-off size of a sheet from the continuous paper sheet and controlling the separating operation of the pair of the upper and the lower feed-in rollers and the pair of the upper and the lower high speed rollers.

It is the second purpose of the present invention is to provide a continuous paper sheet tearing-off apparatus enabling setting of the gaps between the upper and the lower feed-in rollers, and between the upper and the lower high speed rollers at the instant of tearing-off.

It is the third purpose to provide a continuous paper sheet tearing-off apparatus for correcting any error, if any, in the measured tearing-off size of the sheet of paper in order to tear-off the sheets from the continuous paper sheet at the correct position.

It is the fourth purpose to provide a continuous paper sheet tearing-off apparatus which makes it possible to measure the tearing-off size only when the paper sheet is correctly set at its predetermined position.

It is the fifth purpose is to provide a compact continuous paper sheet tearing-off apparatus which is able to carry out a correct tearing-off operation.

In order to accomplish the first purpose of the present invention, the continous paper sheet tearing-off apparatus has a pair of the feed-in rollers and another pair of high speed rollers, both the pairs being separated in the horizontal direction and the rollers respectively in the same pair being arranged so as to approach each other and move apart from the opponent in the vertical direction, a blade situated between the pair of feed-in rollers and the pair of high speed rollers, a paper sheet size measurement device for measuring at least the long side of the continuous paper sheet through, for example, an optical means, and an approach timing control device for controlling according to the measurement result the timing of the sheet nipping operations of the pair of feed-in rollers and the pair of high speed rollers in the vertical direction, and the approaching or nipping movements, respectively of both the pair of feed-in rollers and the pair of high speed rollers at the tearing-off time of the continuous paper sheet causing a difference in the paper transfer speed and a blade is applied to the continuous paper sheet so as to tear-off a sheet at the same time. As described above, the high tearing-off precision of the paper sheet is attained by automatically measuring the long side or the length of the continuous paper sheet and controlling the nipping timing of the pair of the upper and the lower feed-in rollers and the pair of the upper and the lower high speed rollers approaching vertically.

In order to attain the second purpose, the continuous paper sheet tearing-up apparatus according to the present invention has a pair of feed-in rollers, another pair of high speed rollers, a blade, an input means for manually or automatically using various sensors inputting the information of the thickness of the continuous paper sheet to be torn, and a nipping-gap control means for controlling the vertical distances between the pair of feed-in rollers and the pair of high speed rollers. In consequence, it is possible to keep the suitable distances or gaps between the upper roller and the lower roller of each pair according to the thickness of the paper sheet by adjusting the distance between the upper roller and lower roller of each set of rollers on the basis of the thickness.

Further, in order to attain the third purpose of the present invention, the continuous paper sheet tearing-off apparatus provides a pair of the upper and the lower feed-in rollers rotating at a predetermined speed, another pair of upper and lower high speed rollers rotating at a speed higher than the predetermined speed, a sheet size measurement device for measuring at least the length of the sheet to be torn off the continuous paper sheet folded in a shape of zig-zag, a standard size memory portion for memorizing previously a plurality of standard sizes of the continuous paper sheet, and a size adjusting portion for correcting the size of the paper sheet measured by the sheet size measurement device to a standard size near to and on the basis of the standard size memorized by the standard size memorizing portion so as to set the tearing-off position of the continuous paper sheet to be torn by the pairs of the feed-in rollers and the high speed rollers based on the standard size of the paper sheet corrected in the size adjusting portion. As described above, even through some error occurs in the measurement of the paper sheet size, the error can be corrected on the basis of the standard size previously inputted and the tearing-off position of the continuous paper sheet is set so as always to tear-off the sheet at the exact correct position.

Furthermore, in order to attain the fourth purpose, the continuous paper sheet tearing-off apparatus according to the present invention has a pair of upper and lower feed-in rollers, respectively rotating at a predetermined speed, a pair of upper and lower high speed rollers, respectively rotating at a speed higher than the predetermined speed, a sheet size measurement device for measuring at least the distance or length of sheets to be torn off the continuous paper sheet folded in a zig-zag condition and positioned on a stand, a detecting device for dispatching a placing signal when the folded continuous paper sheet is placed on the stand at a predetermined position, and a measurement control portion for issuing size measurement ordering signals to the sheet size measurement device, in order to set the tearing-off position of the paper sheet torn off by the pair of feed-in rollers and the pair of high speed rollers based on the sheet size signals from the sheet size measurement device. It is noted that when the continuous folded paper sheet is not placed on the stand at the predetermined position, no measurement of the sheet by the sheet size measurement device is carried out. In consequence, the sheet is always measured correctly.

In order to attain the fifth purpose, the continuous paper sheet tearing-off apparatus according to the present invention has a pair of upper and lower feed-in rollers rotating at a predetermined speed and nipping the sheet at least at the tearing instant, a feeding portion for transferring or feeding the continuous paper sheet, a pair of upper and lower high speed rollers rotating at a speed higher than the pair of feed-in rollers and approaching each other at the tearing instant so as to nip the continuous paper sheet running through the rollers in order to tear-off the paper sheet using the speed difference of the high speed rollers from the feed-in rollers, a sheet edge detection portion for detecting the front edge of sheet transferred to that position, a tearing-off size input portion, for example a sheet size measurement apparatus, for manually or automatically inputting the tearing-off size of the sheet to be torn from the continuous paper sheet and a control means for controlling the approaching operation of the pair of upper and lower high speed rollers according to the signals from the sheet edge detection portion, a tearing-off size signal dispatched from the tearing-off size input portion (or a sheet size signal from the sheet size measurement apparatus), and information on the transferred length of the continuous paper sheet at the feeding portion. Because the continuous paper sheet tearing-off apparatus of the present invention has the feeding portion having a sheet transfer function, it is possible to transfer the continuous paper sheet without installation of a transfer device, such as a tractor mechanism and the like. Control of each of the high speed rollers carried out on the basis of the transfer length of the continuous paper sheet fed through the feeding portion and the tearing-off size enables the continuous paper sheet tearing-off apparatus to carry out a correct tearing-off operation.

BRIEF DESCRIPTION OF THE DRAWINGS

FIGS. 1–9 depict the preferred first embodiment of the continuous paper sheet tearing-off apparatus according to the present invention, in which:

FIG. 1 is a diagrammatic view of the construction of the overall continuous paper sheet tearing-off apparatus;

FIG. 2 is a diagrammatic side elevation of a pair of the upper and lower feed-in rollers and a pair of upper and lower high speed rollers and a moving mechanism for moving the respective rollers vertically;

FIG. 3 is a plane view of a stand including a paper sheet size measurement device, FIGS. 4 and 5 are sectional views of the stand with the paper sheet measurement device;

FIG. 6 is a plan view of the continuous paper sheet;

FIG. 7 is a flowchart of a sheet size measurement and a correction operation to the standard size;

FIG. 8 is a flowchart showing the control operation of a CPU for the moving mechanism for driving the feed-in rollers and the high speed rollers in the vertical approaching and separating direction;

FIG. 9 is a time chart depicting the output condition of control signals corresponding to the sheet thickness.

FIGS. 10–12 depict the preferred second embodiment of the present invention in which;

FIG. 10 is a diagramatic view of the overall structure of the continuous paper sheet treatment apparatus;

FIG. 11 the feeding portion provided with a pair of upper and lower feed-in rollers, a pair of upper and lower high speed rollers and a moving mechanism for moving respective rollers along their approach and separating vertical directions; and FIG. 12 is a perspective view showing the feeding portion.

DETAILED DESCRIPTION OF THE INVENTION

Figure 1:
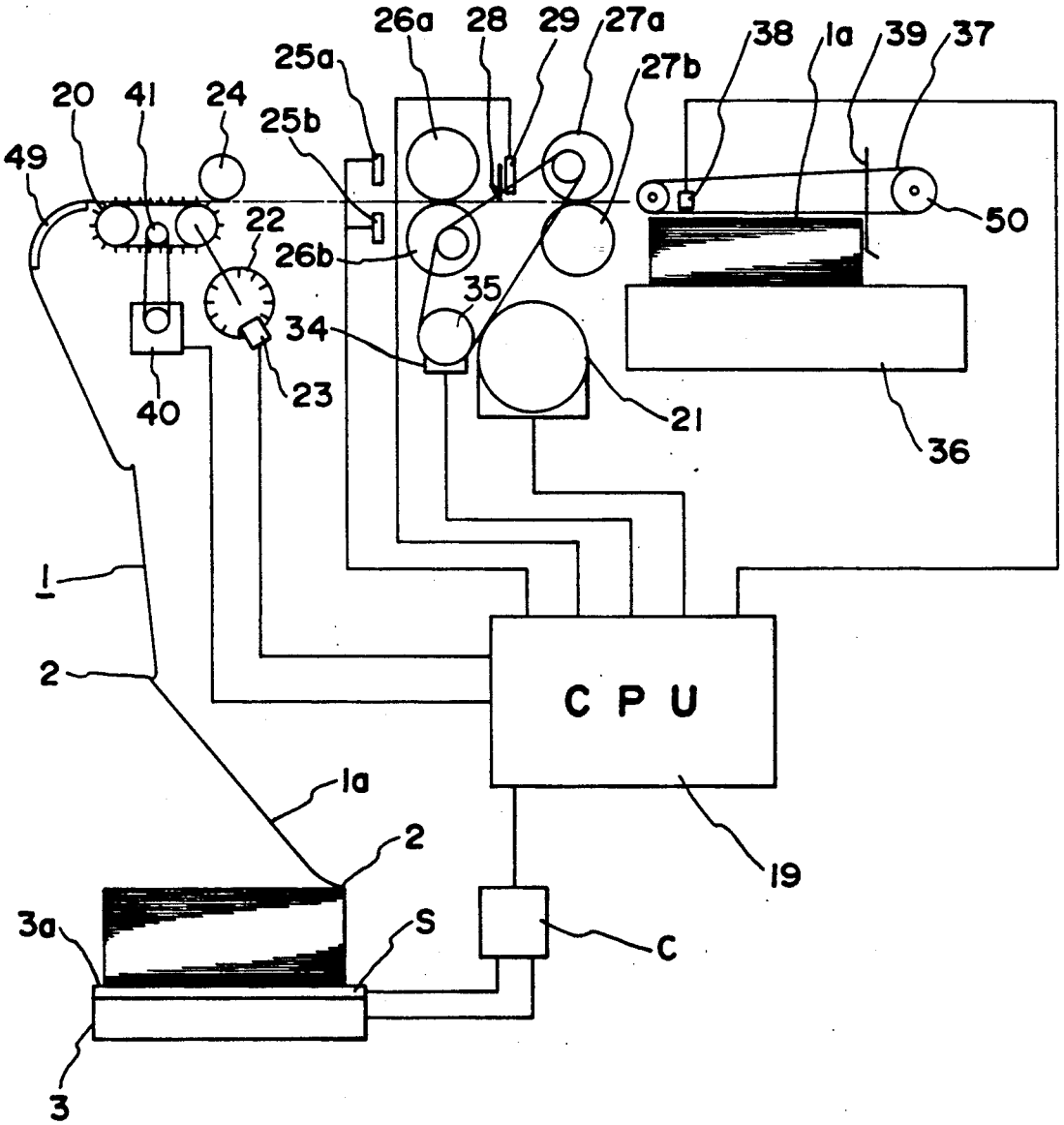
Figure 6:
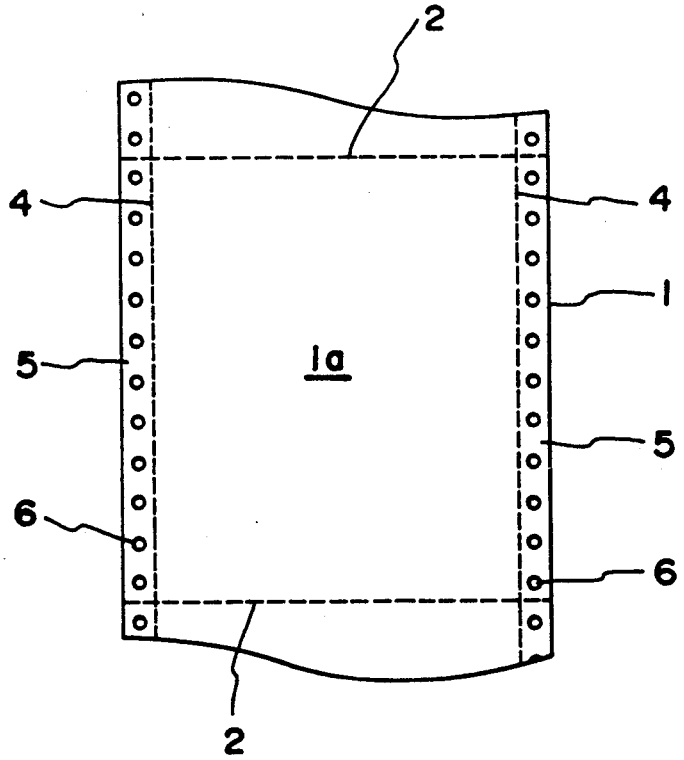

As shown in detail in FIG. 1, the continuous paper sheet 1 from which the unit sheets 1*a* are to be torn off is placed on the support stand 3 at a predetermined position. The paper sheet 1 is folded at the lines of perforations where the sheet is to be bent and torn in a zig-zag shape and placed on the stand 3. The stand has a sheet size measurement device therein for measuring the width and the length of the folded sheets, which is the width and the length of a unit sheet 1*a*. As seen in FIG. 6, the continuous paper sheet 1 has marginal portions 5 formed at the both sides in the longitudinal direction of the sheet, being bounded by tearing-off perforations 4. In the marginal portions, there are a plurality of marginal holes 6 and 6 spaced uniformly in the axial direction of the sheet.

Figure 3:
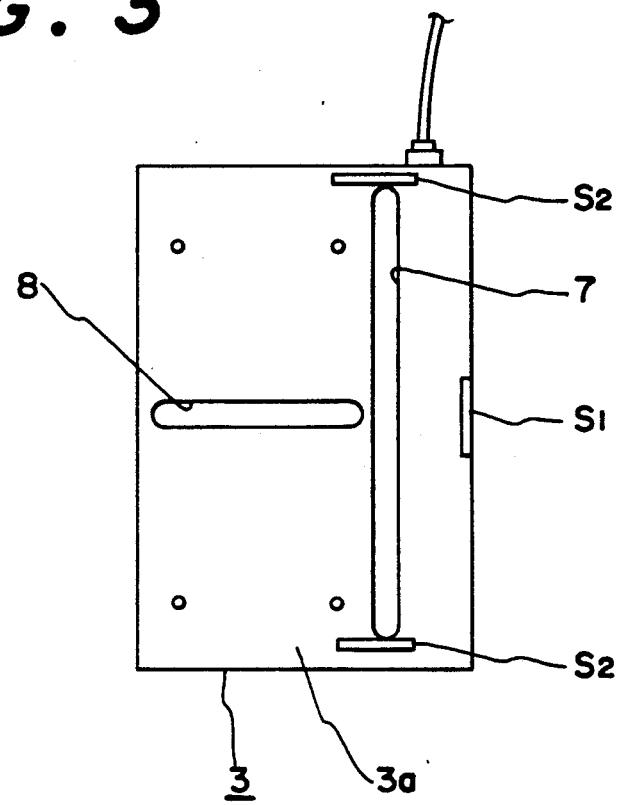
Figure 4:
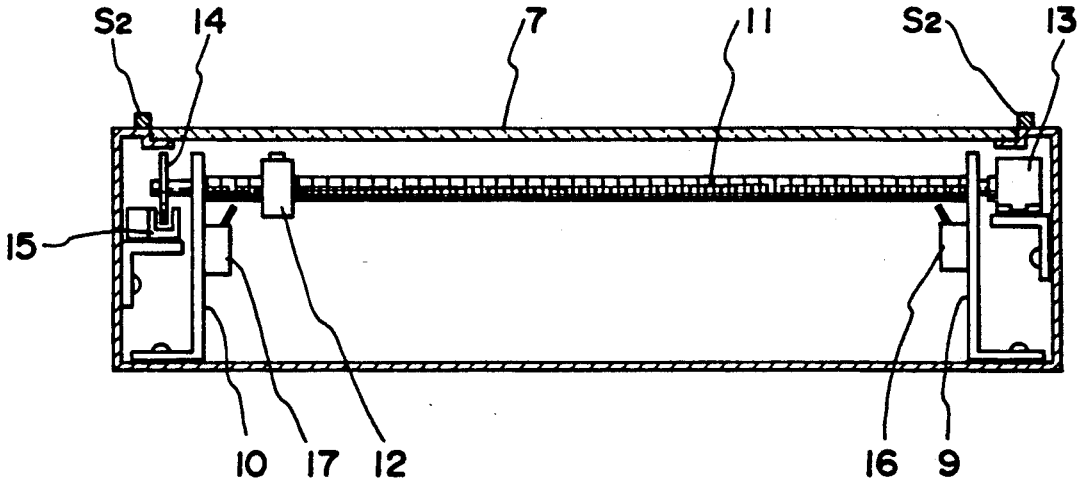

Next, the sheet size measurement device will be explained. As shown in FIG. 3, the stand 3 has a support plate 3*a* on which the continuous paper sheet 1 is placed. There are, on the plate 3*a*, a long light transparent portion 7 extending in the width direction of the continuous sheet for measuring the width of the unit paper sheet 1*a*, and another long light transparent or transmitting portion 8 extending in the direction perpendicular to the direction of the light transparent portion 7 and for measuring the length of the unit paper sheet 1*a* in its continuous or extending direction. As shown in FIG. 4, at the position corresponding to the light transparent portion 7 formed in the plate 3*a*, a rotary shaft 11 is provided rotatably supported on the support plates 9 and 10, respectively fixed in the stand 3. A phototube 12 having a rotation preventer (not shown) is fixed to the rotary shaft 11. At one end of the rotary shaft 11, there is a driving motor 13 connected thereto. At the other end of the shaft, there is a slit plate 14 fixed thereto. Corresponding to the lower edge of the slit plate 14, there is a slit detection device 15 fixed to a supporting plate (unnumbered). On a supporting plate 10 and another supporting plate 9 on the other end, there are respective limit switches 16 and 17 installed so as to sense the ends of the travelling path of the phototube 12. The mechanism or construction described above measures the width of the unit sheet 1.

Figure 5:
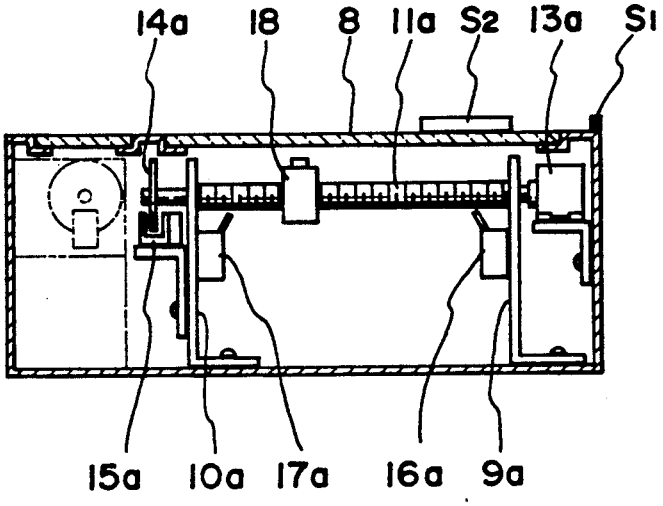

As shown in FIG. 5, at the position corresponding to that of the light transparent portion 8 in the stand 3 on which the paper sheet is placed, a mechanism for measuring the length of the unit sheet 1*a* is placed, which mechanism has a phototube 18 and is similar to that for measuring the width of the unit sheet 1*a* as described above. Concerning the mechanism for measuring the length of the unit sheet, the same reference numerals with suffixes "a" are applied to the respective parts corresponding to the parts of the width measurement mechanism above and a detailed explanation of the length measurement mechanism is omitted.

In operation of the continuous paper sheet tearing-off apparatus according to the present invention, the width and the length of the unit sheet 1*a* are measured by rotation of the rotary shafts 11 and 11*a* for causing movement of phototubes 12 and 18. The amount of rotation is determined by the number of times the slits in plates 14 move past the slot detection mechanisms 15, each time corresponding to an equal pitch of movement of the phototubes 12 and 18, and then the number of times is detected by the slit detection mechanisms 15 and 15*a*. The sheet size signal detected is sent to the size controlling portion of a CPU 19 through a measurement control portion C shown in FIG. 1.

A sensor $S_1$ for detecting whether the continuous paper sheet 1 is correctly placed at a predetermined position of the plate 3*a* is installed at a position along a wall plate (not shown) of the continuous paper sheet treating apparatus. A pair of sensors $S_2$ and $S_2$ for detecting whether the continuous paper sheet 1 is wrongly placed on the plate 3*a* are installed at the longitudinal ends of the light transmitting portion 7. The detection apparatus S consisting of the central sensor $S_1$ and two side sensors $S_2$ and $S_2$ is adapted to dispatch a placement signal when the continuous paper sheet 1 is placed at the predetermined position. In consequence, the placement signal is issued when the sensor $S_1$ is ON and the sensors $S_2$ and $S_2$ are OFF. When a placement signal is issued from the detection apparatus S, a size measurement order signal is issued from the measurement control portion C to the sheet size measurement apparatus. A sheet size signal from the slit detection devices 15 and 15*a* of the sheet size measurement apparatus is sent to the size control portion through the measurement control portion C.

The size control portion compares the inputted measurement value to a standard size memorized in the standard size memorizing portion in the CPU 19 in order to correct it to the nearest standard size. When the measured value is situated, in the correction operation, midway between two standard sizes, it is raised to the larger standard size so as to correct the measurement value. The standard size memorizing portion has the standard width sizes of the unit sheet 1*a* in increments of 1/10 inch and the standard length sizes of the unit sheet 1*a* in increments of ½ inch. The number of the width and the length standard sizes are suitably determined and memorized in the memorizing portion.

As shown in FIG. 1, the continuous paper sheet 1 placed on the stand 3 is pulled or drawn out upwardly and guided on a guide plate 49. The marginal holes 6 and 6 formed at both the margins of the paper sheet 1 are engaged with engaging pins of a paper drive device 20 driven by a main motor 21 as indicated by the claim line. Thus, the paper sheet 1 is fed rightwardly in FIG. 1. The transfer or feeding speed of the paper sheet 1 is detected by a detector 23 installed in the paper drive encoder 22 for detecting the speed of rotation of the paper drive device 20 and the detected speed signal is sent to the CPU 19. A slitter 24 installed near the rearward or downsteam end of the device 20 cuts off the margins 5 and 5 from the sheet 1 through the perforations 4 and 4, the sheet 1 is further sent in the same direction, and it is supplied to a tearing-off apparatus.

The respective wheels of the pairs of wheels of the paper drive device 20 which are opposite sides of the path of the continuous paper sheet are controlled or moved by gear 41 to which a driving force of a sub motor 40 is supplied and the distance between these wheels is adjusted. The parts of the slitter 24 on opposite sides of the path are moved together with the wheels. The motor 40 is driven and controlled by a control signal from the CPU 19, which control signal is obtained by correcting the resultant width of the unit sheet 1*a* as measured by the sheet size measurement apparatus. The distance between the wheels of the paper drive 20 is set at a distance narrower than the width of the continuous paper sheet 1 measured by the phototube 12 by 0.5 inch, so that the marginal holes 6 and 6 placed inside from the longitudinal edges of the paper sheet by 0.25 inch are matched to the engaging pins.

A set of sheet thickness detectors 25*a* and 25*b* for detecting the sheet thickness according to the volume of light transmitted therethrough as "thin", "middle" and "thick" are placed in opposed relationship along a vertical line and sandwiching the traveling path of the continuous paper sheet 1, and they dispatch a detection signal to the CPU 19. These sheet thickness detectors 25*a* and 25*b* constitute an input means for inputting information on the paper sheet thickness of the continuous paper sheet 1.

As shown in FIG. 1, following the paper sheet thickness detectors 25*a* and 25*b*, there are a pair of upper and lower feed-in rollers 26*a* and 26*b* one of which is movable toward and away from the other in a vertical direction, a and another pair of upper and lower high speed rollers 27*a* and 27*b* situated downstream in the direction of paper feed of the pair of rollers 26*a* and 26*b* and one of which is also movable away from the other. The gaps between the upper rollers and the lower rollers of these pairs are about 1 to 1.5 mm. These pairs of rollers are driven by the main motor through a driving force transmitting mechanism (not shown), so that the high speed rollers 27*a* and 27*b* are driven at a speed faster than the rollers 26*a* and 26*b*.

Between these pairs of the feed-in rollers 26*a* and 26*b*, and the high speed rollers 27*a* and 27*b*, there is a blade 28 to be applied to the perforations 2 extending in the width direction (see FIG. 6) so as to bend and tear the continuous paper sheet 1 along the line of the perforations, and a sheet edge detector 29 of a high reflection type for detecting the front edges of the continuous paper sheet 1 sheet. When the front edge of the continuous paper sheet I is detected by the paper sheet front edge detector 29, the detector 29 outputs detection signals to the CPU 19.

Figure 2:
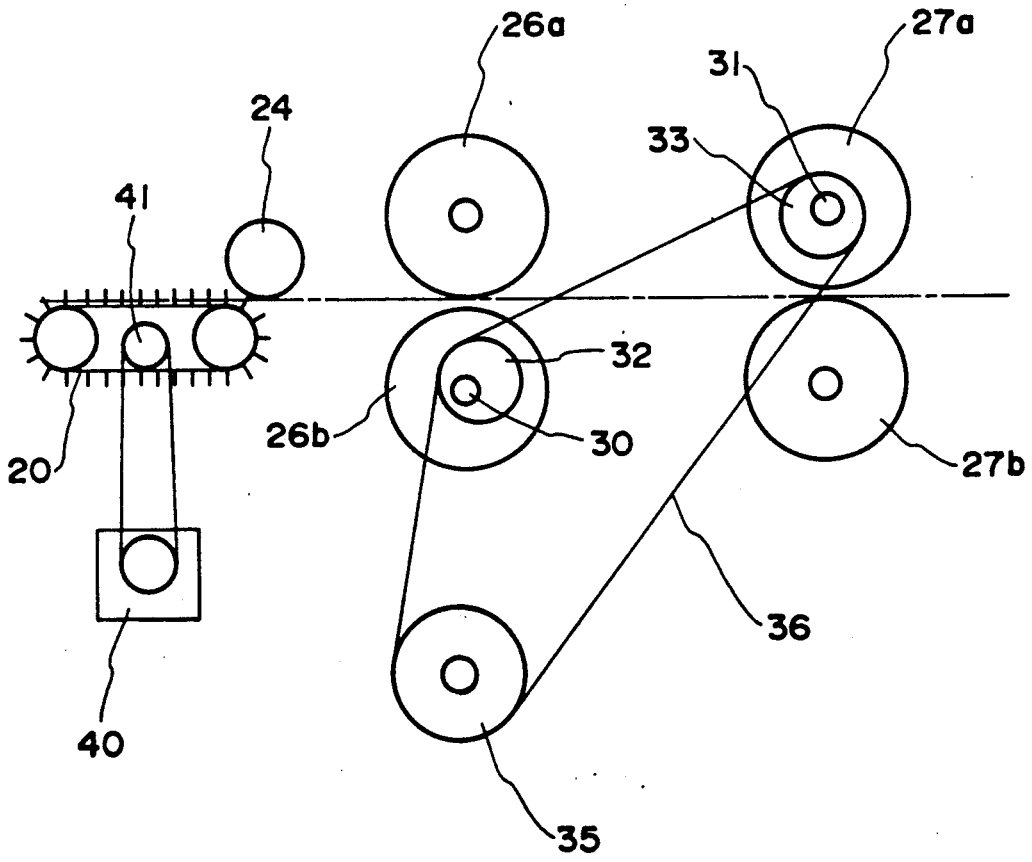

With reference to FIG. 2, a gap adjusting means or mechanism is provided for moving the movable roller of the respective pairs of the feed-in rollers 26*a* and 26*b*, and the high speed rollers 27*a* and 27*b* toward and away from the other. The rotary shaft 30 of the lower feed-in roller 26*b* and the rotary shaft 31 of the upper high speed roller 27*a* are supported eccentrically by bearings 32 and 33 respectively. Rotary bearing shafts (not shown), respectively installed at the centers of the bearings 32 and 33 are rotatably mounted on the machine frame (not shown). As shown in FIGS. 1 and 2, around a driving pulley 35 fixed to an output shaft of a pulse motor 34 and the bearings 32 and 33, an endless belt 36 is wound. The pulse motor 34 is connected to the CPU 19 functioning for controlling the timing of the movement of the movable rollers toward the fixed rollers, and its output shaft rotates by a predetermined amount in a predetermined direction according to a driving control signal according to the standard length size corrected in the size control portion of the CPU 19. Accordingly, also the driving pulley 35 rotates in the same direction and the same amount as the output shaft. The rotation is transferred to respective bearings 32 and 33 through the endless belt 36. Owing to the rotation of the bearings 32 and 33 around the bearing shafts (not shown), the rotary shafts 30 and 31 rotate along an arc in the same direction.

In consequence, when the driving pulley 35 is rotated by the pulse motor 34 clockwise in FIG. 2, the roller 26*b* is raised and the roller 27*a* is lowered, approaching the opposed roller of the respective pairs. On the contrary, when the driving pulley 35 rotates counterclockwise, the roller 26*b* is lowered and returns to its original position and roller 27*a* rises to its original position. As a result, when the rotary movement of the output shaft of the pulse motor 34 is controlled by the CPU 19, the gaps or vertical distances between the feed-in rollers 26*a* and 26*b*, and the high speed rollers 27*a* and 27*b* are adjusted and then the tearing of the continuous paper sheet 1 is caused to occur when the rollers are spaced the least distance.

As shown in FIG. 1, after the tearing-off mechanism, there is a stacker device for sequentially stacking the unit sheets 1*a* cut or torn of the continuous sheet. This stacker device has an elevatable table 36 on which the unit paper sheets 1*a* are placed. In order to firmly and one by one stack the unit sheets 1*a* on the elevatable table 36, a conveying guide belt means 37 is placed at a suitable position, which has two thin belts (one belt is shown) running in parallel and along a continuous path in order to guide and pull the unit sheets 1*a* onto a stack. The sheet pull-in speed of the thin belts in higher than the sheet discharge speed of the tearing-off apparatus. Further, a stopper 39 movable in the advancing direction of the unit sheets and on which the front edges of the unit sheets Ia hit, and a stacked sheet volume detecting device 38 for detecting the position or level of the uppermost or top unit sheet 1*a* of the stack of unit sheets on the elevatable table 36 and issuing a detection signal for lowering the table 36 when the detected level becomes higher than a predetermined level to the CPU 19 are installed on the stacker apparatus as shown in FIG. 1.

The conveying guide belt means 37 has a pair of driving rolls 50 on which the thin belts are wound and the rolls have projections (not shown) on their peripheries, so that a part of the thin belt intermittently is pushed down by the projections. As a result, even if some error is generated in the descending motion of the elevatable table 36 and the table descends a little lower than the correct height, the conveying guide belt 37 can firmly engage with unit sheets 1 to convey them and each unit sheet 1*a* strikes the stopper, so that the unit sheet 1*a* is always lightly and smoothly stacked on the elevatable table 36.

The operation of the preferred embodiments of the continuous paper sheet tearing-off apparatus according to the present invention constructed as described above will be explained.

Figure 7:
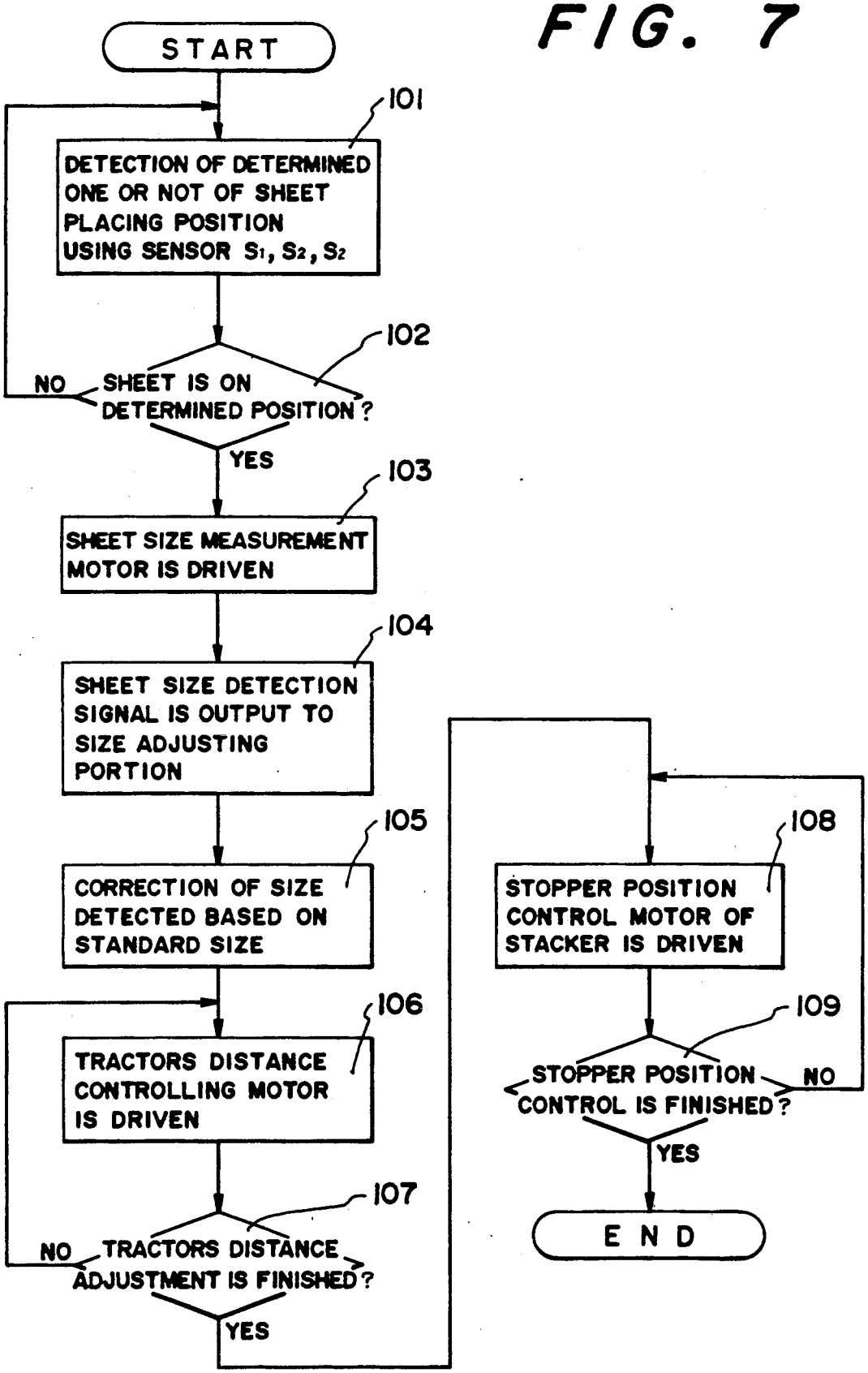

First, as shown in FIG. 1, the continuous sheet 1 is placed on the placement table 3 in a predetermined folded condition at a predetermined position on the table 3 and a measurement operation of the sheet size is carried out. The measurement operation is explained with reference to FIG. 7, together with the control operation of the CPU 19.

When the continuous paper sheet 1 is stacked on the table 3 in the predetermined folded condition, the sensors $S_1$, $S_2$, and $S_2$ sense or detect the position of the continuous sheet 1 determing whether the position is the predetermined one or not (Step 101). When the placement signal is issued after it has been judged that the continuous paper sheet 1 is placed at the proper placement position (Step 102), a size measurement order signal is issued from the measurement control portion C and the driving motors 13 and 13*a* are driven. As a consequence, the rotary shafts 11 and 11*a* are driven in order to move phototubes 12 and 18 along respective rotary shafts 11 and 11*a* (Step 103).

Concerning the width measurement process, the moving or travelling distance measured from the instant that light of the phototube 12 being passed through the light transparent portion 7 is interrupted by the continuous paper sheet 1 to the instant that light of the phototube again passes through the light transparent portion 7 corresponds to the width of the continuous paper sheet 1. The number of times the slits pass the detector corresponding to the moving distance described above is counted in the slit detection apparatus 15 from the instant of interrupting the light to other instant of retransmitting the light. The counted number is converted to the moving distance of the phototube 12 and used as a detection signal which is outputted to the size control portion of the CPU 19 (Step 104). A size adjusting portion of the CPU 19 compares the width detection signal to the standard widths previously memorized in a standard size memorizing portion in order to adjust it to the similar or nearest standard width (Step 105). When a width detection signal corresponding to, for example, 3.24 inch is issued, the width standard size with a unit of 1/10 inch is memorized in the standard size memorizing portion, and it is determined that the size of 3.24 inch is between 3.2 inch and 3.3 inch and it is corrected to 3.2 inch. After that, the CPU 19 sends a drive control signal based on or according to the corrected value to the motor 40 (Step 106) and the distance between the wheels of the paper drive means 20 is adjusted through the gear 41 so as to be match the width of the continuous paper sheet 1 (Step 107).

In the operation of the length measurement because the phototube 18 is at its interrupted condition due to the continuous paper sheet 1 placed in the predetermined placement condition at its movement starting position, the number of times the slit passes the detecting means corresponding to the moving distance from the movement starting instant to the light transmitting instant is counted from the movement starting instant to the light passing instant. Then, the counted number or the corresponding moving distance is added to the distance from the position of the phototube 18 to the position of the edge of the continuous paper sheet 1 at its initial position. The resultant sum is outputted to the size memorizing portion of the CPU 19 as a length detection signal of the folded portions of the continuous sheet 1 corresponding to a unit sheet (Step 104). The size adjusting portion compares the length detection signal to the standard lengths previously memorized in the standard size memorizing portion in order to adjust it to the similar or nearest standard length (Step 105). When a length detection signal corresponding to 4.25 inch is obtained, because the length standard size is in units of ½ inch in the standard size memorizing portion, the size of 4.25 inch is determined to be at the mid point between 4.0 inch and 4.5 inch. Raising the number, it is adjusted to 4.5 inch.

Next, the CPU 19 sends a drive control signal according to the adjusted number of 4.5 inch to a driving motor (not shown) for adjusting the position of the stopper 39 of the stacker device (Step 108) and the position of the stopper 39 is adjusted so as to fit to the length of the unit sheet 1*a* (Step 109). The length detection signal previously adjusted is stored in a memory in a memory of the CPU 19.

Then, the continuous paper sheet 1 stacked on the stand 3 is pulled up and is passed over guide plate 49 and reaches the paper drive means 20 having two pairs of wheels at a controlled separation distance. The marginal holes 6 and 6 of the continuous paper sheet 1 are engaged with the pins on the wheels of the paper drive means 20 and then the main motor 21 is driven. In consequence, the continuous paper sheet 1 is transferred to the right in FIG. 1 and the marginal portions or margins 5 and 5 are cut off by the slitter 24 after the moving sheet leaves the drive device 20. The transfer speed of the sheet 1 is detected by the detector 23 and the result is sent to the CPU 19.

Figure 8:
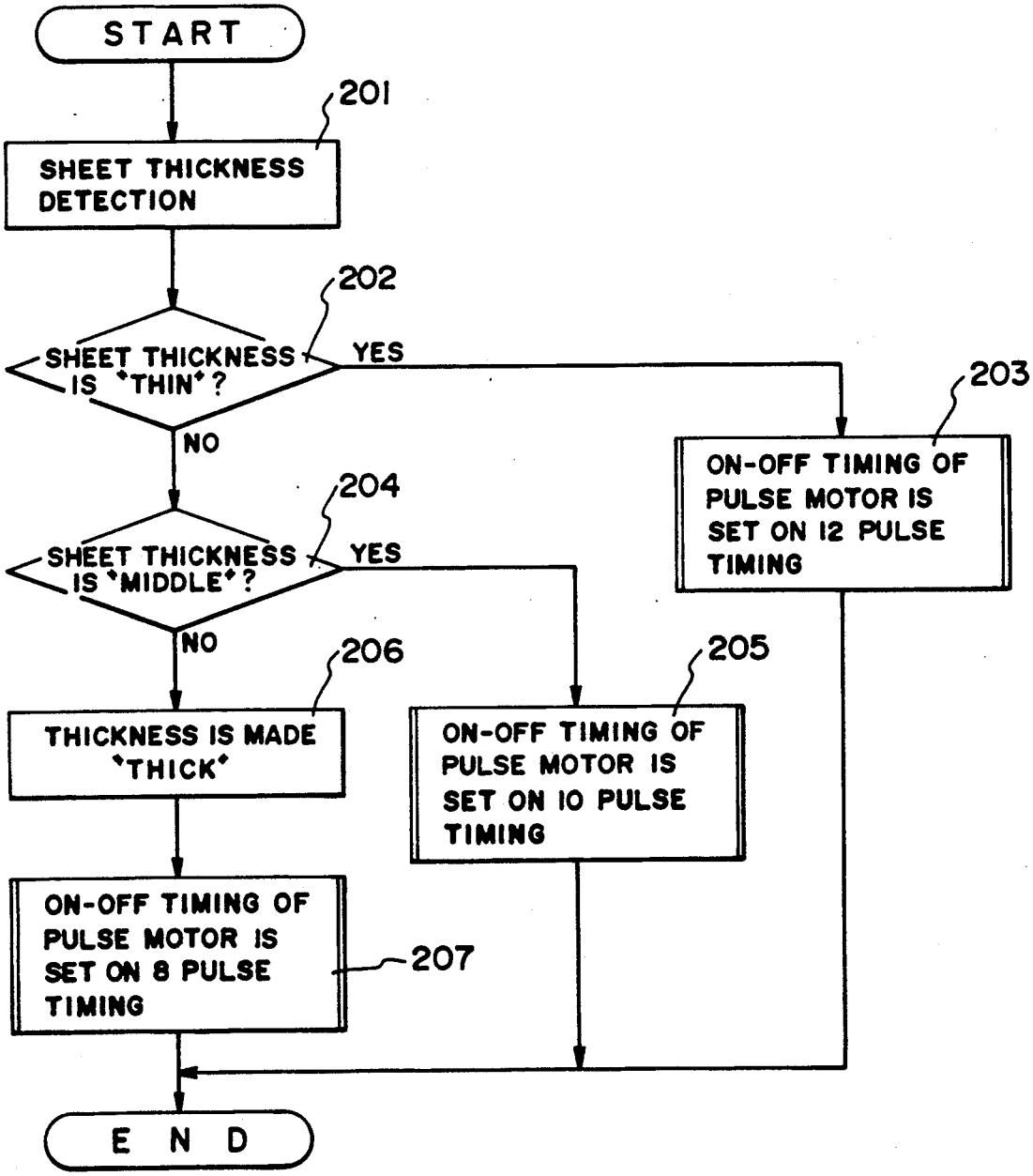
Figure 9:
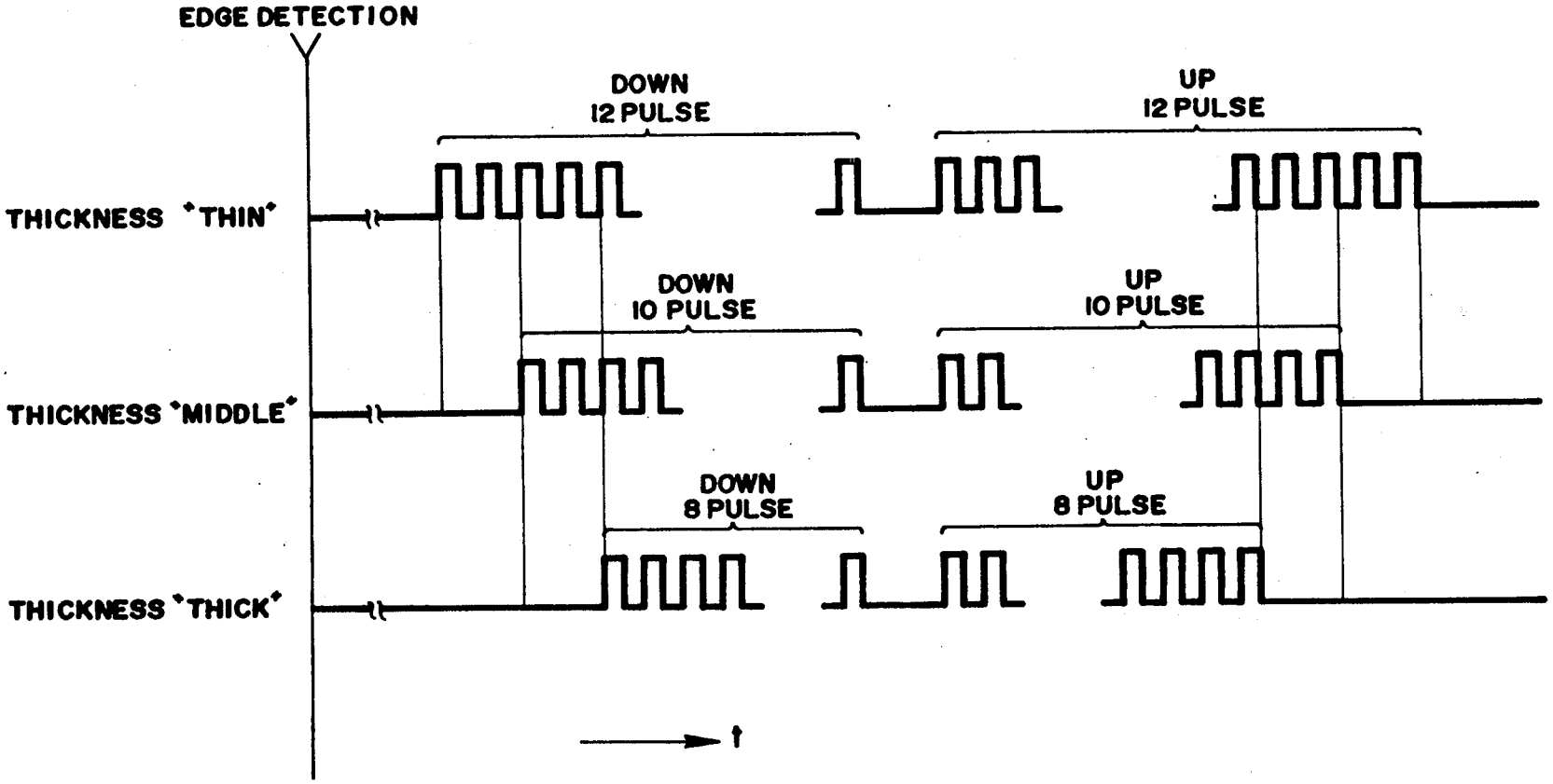

Next, the thickness of the continuous paper sheet 1 detected when it passes through the sheet thickness detectors 25*a* and 25*b* and the result of the detection signal is sent to the CPU 19. The vertical gaps between the upper and the lower feed-in rollers 26*a* and 26*b* and the upper and the lower high speed rollers 27*a* and 27*b* are adjusted by the CPU 19 using this detection signal. The gap adjusting process of the CPU 19 will be described with reference to FIG. 8 and FIG. 9. The abscissa of the graph in FIG. 9 shows the time starting from the instant of the continuous sheet edge detection.

As shown in the drawings, the sheet thickness detectors 25*a* and 25*b* detect the thickness (Step 201). When it is judged to be "thin" (Step 202), an on-off timing of the pulse motor 34 is set to a 12-pulse timing (Step 203). According to the 12-pulse timing shown in FIG. 9, a drive signal is outputted to the pulse motor 34 at an instant earlier than for the standard timing (in case of "middle" thickness) by a time of 2 pulses, the standard timing starting at a predetermined time after the sheet edge detection signal from the detector 29 inputs to the CPU 19. The standard timing in case of "middle" thickness causes the pulse motor to move the respective rollers 26*b* and 27*a* toward the other roller for a sufficient time to form the gap corresponding to the middle thickness, hold this position for a time corresponding to the sheet traveling or transfer speed and the length of the unit sheet 1*a*, and then to raise the respective rollers. Another drive signal for returning the pulse motor stops at an instant later than the standard timing above by a time of 2 pulses. Consequently, the gap between the rollers at the instant the continuous sheet 1 reaches the upper and the lower rollers 26*a*, 26*b* and 27*a*, 27*b* is adjusted to be narrower than the gap for standard timing for the "middle" thickness.

When it is judged that the sheet thickness is not "thin" in Step 202, it will be judged whether it is "middle" thickness or not in Step 204. Then, the on-off timing of the pulse motor 34 is set for a 10-pulse standard timing (Step 205). At the standard timing of the pulse motor 34, starting a predetermined time after the instant at which a sheet front edge detection signal from the sheet edge detector 29 inputs to the CPU 19, the CPU outputs a drive signal to the pulse motor 34 for the standard timing for the length of the unit sheet 1*a* and the sheet traveling speed. The standard gap of these upper and lower rollers equals that obtained when the continuous paper sheet 1 reaches respective rollers 26*a*, 26*b* and 27*a*, 27*b*.

When the thickness of the sheet is not judged as "middle" in Step 204, the sheet is considered to be "thick" in Step 206 and the on-off timing of the pulse motor 34 is set at a 8-pulse timing (Step 207). According to the 8-pulse timing, it is apparent from FIG. 9 that, starting a predetermined time after the sheet edge detection signal from the sheet edge detector 29 inputs to the CPU 19, a drive signal is outputted from the CPU 19 to the pulse motor at an instant later than the standard timing for the length of the unit sheet !a and the sheet traveling speed. In addition, the returning drive signal is stopped at an instant earlier than the standard timing by a time of 2 pulses. As a consequence, the gap attained at the time the continuous sheet 1 reaches respective rollers 26*a*, 26*b* and 27*a*, 27*b* is set to be greater than that for the standard timing (in case of "middle" thickness).

In this manner, the thickness of the continuous paper sheet 1 is detected, then the front edge of the sheet is detected by the sheet edge detector 29, and information of the front edge detection signal is inputted to the CPU 19. Receiving the front edge detection signal, the CPU 19 outputs a drive signal to the pulse motor 34 at a suitable timing determined according to the traveling speed, the corrected length detection signal, and the thickness detection signal, respectively inputted to the CPU. Consequently, when the paper sheet 1 reaches the tearing-off position suitable for the corrected length, both gaps between respective pairs of the upper and the lower feed-in rollers 26*a*, 26*b* and the upper and the lower high speed rollers 27*a*, 27*b* are suitable for the actual thickness of the traveling sheet. The perforations 2 at which the continuous sheet is bent and torn are tensed and pulled so as to be torn by the operation of the respective pairs of rollers and have a blade 28 applied thereto and the continuous sheet 1 is separated into the unit sheets 1*a*.

The unit paper sheets 1*a* thus cut are stacked one by one on the elevatable table 36 by the conveying guide belt 37. The position of the stopper 39 is already adjusted so as to be fitted to the length of the unit sheets 1*a*, so that the sheet conveying motion to the table is done smoothly. When the level of the top unit sheet 1*a* of the stack becomes higher than that of the predetermined position, it is detected by a sheet stack volume detector 38, the resultant detection signal is sent to the CPU 19, the elevatable table 36 is moved by the detected height increase in order to carry out always a smooth stacking operation.

Figure 10:
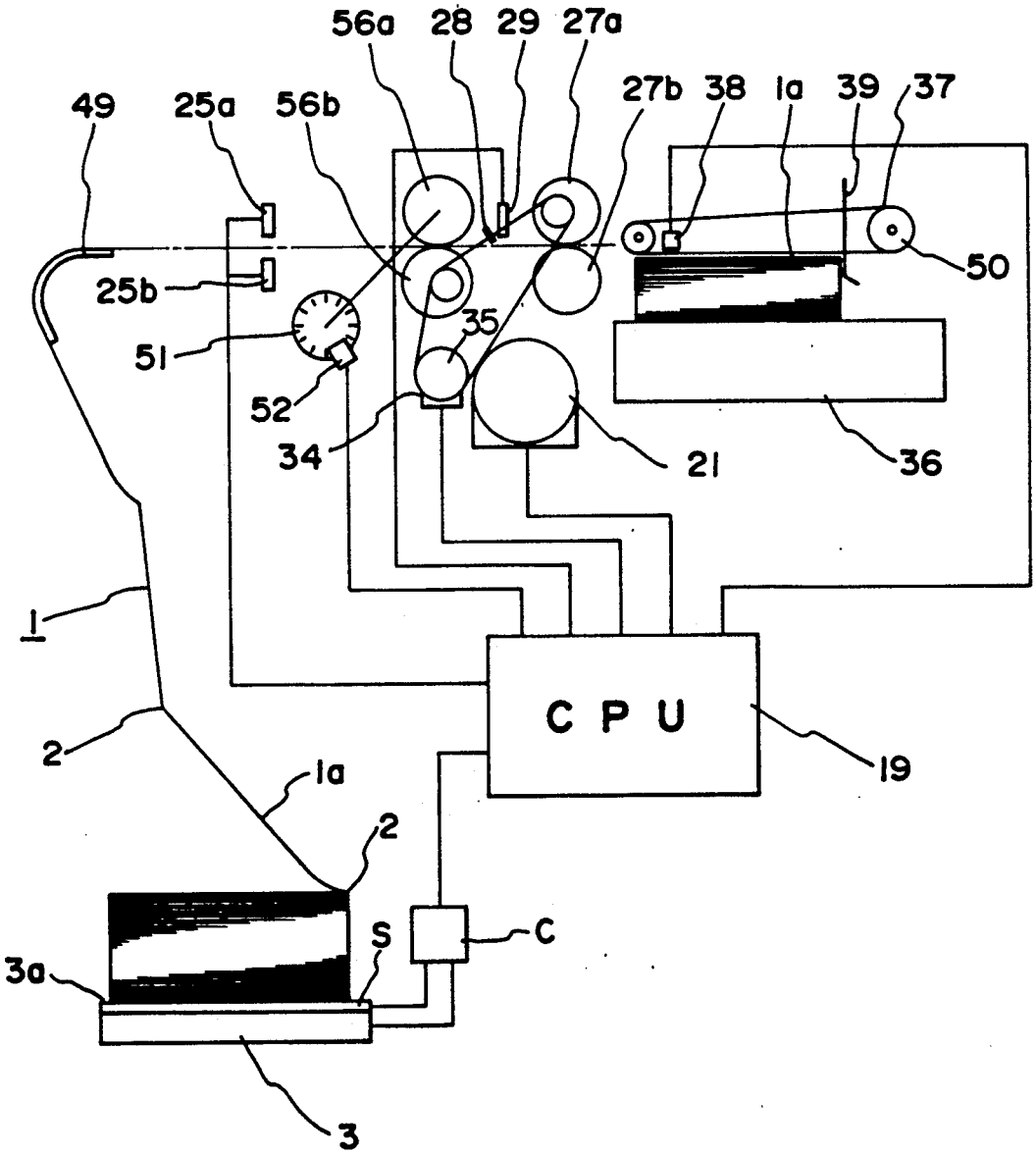
Figure 11:
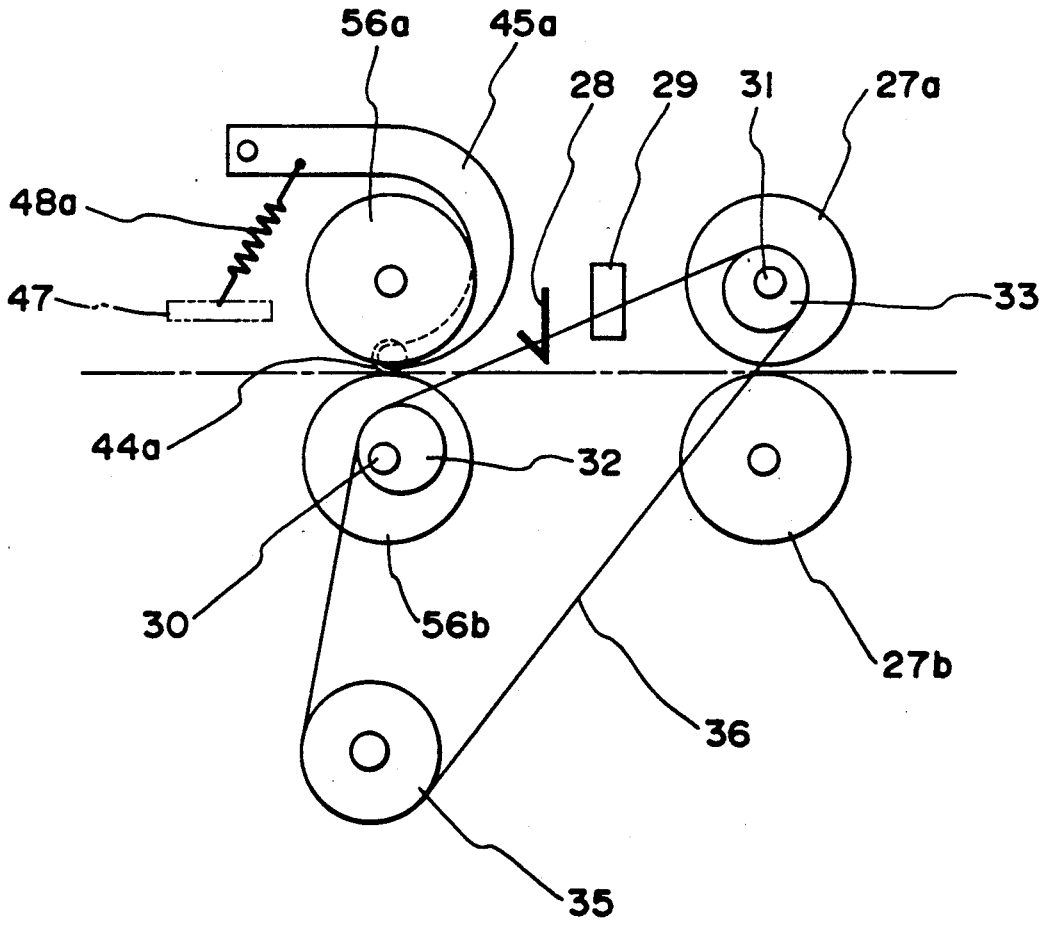
Figure 12:
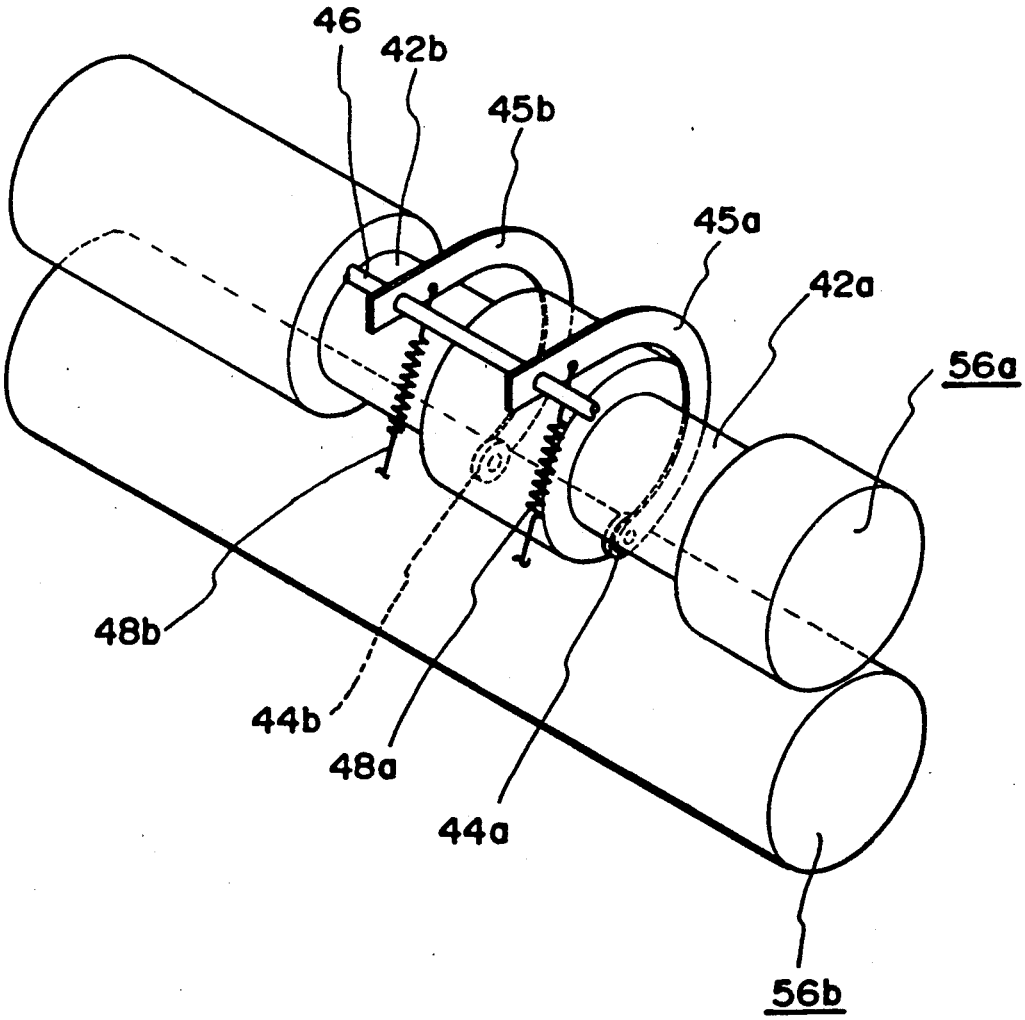

FIG. 10 shows another preferred embodiment of the continuous paper sheet tearing-off apparatus of the present invention, in which there is no paper drive means 20, and the transfer of the continuous paper sheet 1 is carried out by a feeding portion having a sheet transfer function. As is apparent from FIG. 11 and FIG. 12, the feeding portion includes a pair of upper and the lower feeding rollers 56*a* and 56*b*, respectively relatively movable forward and away from each other in the vertical directions. In this embodiment, roller 56*b* is movable by rotation of the cam 32. Usually those opposed rollers are arranged with a gap of about 1 to 1.5 mm. The feeding rollers 56*a* and 56*b*, respectively have three annular grooves 42*a*, 42*b* and 42*c*, and 43*a*, and belt passing grooves 43*b* and 43*c* formed thereon as shown in FIG. 12 spaced in the longitudinal directions of the rollers 56*a* and 56*b*. A pair of curved or inverted J-shaped oscillating arms 45*a* and 45*b* are positioned in the grooves 42*a* and 42*b* of the upper feeding roller 56*a*. The oscillating arms 45*a* and 45*b* have two rotable transfer rolls 44*a* and 44*b* at the one ends which are within the grooves 42*a* and 42*b* and opposite an ungrooved portion of feeding roller 56*b*. The arms curve upwardly over the top of the upper feeding roller 56*a* and extend in the direction opposite the direction of paper feed. Respective other ends of the curved oscillating arms 45*a* and 45*b* are oscillatably mounted on a supporting rod 46 fixed to a machine frame (not shown). The oscillating arms 45*a* and 45*b* are urged clockwise in FIG. 11 due to a compression or contraction force of the springs 48*a* and 48*b* connected between a fixing plate 47 attached to the machine frame and parts adjacent to the other ends of the oscillating arms. In consequence, the transfer rolls 44*a* and 44*b* supported at the ends of the oscillating arms rotatably contact the outer periphery of the lower feed-in roller 56*b*. When the continuous paper sheet 1 is simply being fed, it is transferred by the operation of the lower feeding roller 56*b* and the transfer rolls 44*a* and 44*b*. When respective feeding rollers 56*a*, 56*b* approach each other, respective transfer rolls 44*a* and 44*b* enter into the corresponding grooves 42*a* and 42*b* of the upper feed-in roller 56*a* against the compression forces of the springs 48*a* and 48*b*.

As shown in FIG. 10, a transferred length of the continuous paper sheet 1 or the transfer speed of the sheets through the feeding portion is detected by the detector 52 installed in a feeding roller encoder 51 for detecting the rotation speed of the feeding roller 56*a* and the resultant speed detection signal is sent to the CPU 19. The feed-in rollers 56*a*, 56*b* and the high speed rollers 27*a*, 27*b* are driven by the main motor 21 through a driving force transmitting mechanism (not shown).

In this embodiment of the present invention, any type of continuous paper sheets 1 having margins 5 as described in the first embodiment or not having them or which margins have been cut off from the sheet may be used. If the continuous paper sheet 1 has marginal portions 5, they are transferred without using these marginal portions 5 to drive the paper. Because the remainder of the continuous paper sheet tearing-off apparatus according to this embodiment has a construction similar to the first embodiment, the corresponding structural parts are shown by the same numerals thereto and no explanation for the parts is provided in the specification. According to the preferred embodiment, the sheet size measurement device constitutes a tearing-off size inputting portion.

In this embodiment, the continuous sheet 1 is pulled up gradually, and led between the feeding rollers 56*a* and 56*b* over the guide plate 49, and nipped between the transfer rolls 44*a*, 44*b* and the lower feeding roller 56*a*. Then, the main motor 21 is driven to transfer the continuous paper sheet 1. The remaining operation of the apparatus is the same as that of the first embodiment and its explanation is omitted.

According to the second embodiment of the present invention, there is no need to install any transfer mechanism for the continuous sheet 1, so that it is possible advantageously to simplify the construction of the whole construction of the continuous paper sheet tearing-off apparatus and to make it more compact. Also, it is possible to construct the feeding roller 56*a* and 56*b* so as to always hold or nip the continuous paper sheet 1. In such case, there is no need to install the transfer rolls 44*a* and 44*b*. It is also possible to input a tearing-off size of the sheet by manual operations, such as button pressing and the like.

It is further possible to provide a third embodiment which is like the first embodiment, but in which the feeding portion provided with feeding rollers 56*a* and 56*b* described in the second embodiment above in provided in place of the feeding rollers 26*a* and 26*b* used in the first embodiment of the present invention. According to the third embodiment, the length of sheet transferred through the feeding portion or the sheet travelling speed through the feeding portion are not detected by detecting the rotation speed of the feeding rollers 56*a* and 56*b*, by they are instead detected by using the detector 23 on the encoder 22 so as to detect the rotation speed of the paper feed means 20 having the same driving source as that of the first embodiment (see FIG. 1).

The continuous paper sheet 1 usable in the third embodiment of the present invention includes sheets having marginal portions 5 and sheets not having the marginal portions. That is, it is possible not only to transfer a continuous paper sheet 1 by using the marginal portions 5 adapted to be engaged with the paper feed means 20, but also to transfer the sheet using the feeding portion constituted by the feeding rollers 56*a* and 56*b*.

When the sheet 1 is transferred without using these marginal portions 5, two opposing parts of the paper feed means 20 are separated by a rotation of the gear 41 to which a driving force of the motor 40 is supplied, together with the slitter 24 for cutting-off the marginal portions 5, so that the continuous sheet 1 can pass the paper feed means freely without interruption.

It is noted that the present invention is not limited to respective embodiments described above. It is not always necessary to operatively join the control of the vertical gaps between the feeding rollers 26*a*, 26*b*, 56*a*, 56*b* and the high speed rollers 27*a* and 27*b* to the detection of the sheet thickness. It is not necessary to use a pulse motor 34 as the driving source for reducing the vertical gaps between the rollers. Further, it is possible to transfer the continuous paper sheet 1 by rollers and the like instead of using the paper feed means 20. It is not always necessary to carry out the measurement of the width of the continuous paper sheet 1. The measurement of the width can be done by using some elements other than the phototubes 12 and 18, and various constructions of the sheet size measurement device can be used in the sheet tearing-off apparatus according to the present invention. It is also possible to use some manual inputting means, such as input buttons for inputting the thickness information of the continuous sheet 1 other than the automatic input means, such as the sheet thickness detectors 25*a* and 25*b*. The vertical gaps between the rollers 26*a*, 26*b*, 56*a*, 56*b*, 27*a*, 27*b* can be left unchanged when the sheet is torn after the gaps are adjusted according to the sheet thickness. Furthermore, it is possible to set the tearing-off position of the continuous paper sheet 1 by controlling not only the vertical gap sizes between the feeding rollers 26*a*, 26*b*, 56*a*, 56*b* and the high speed rollers 27*a*, 27*b*, but also the distance in the sheet transfer direction between the positions of the feeding rollers 26*a*, 26*b*, 56*a*, 56*b* and the high speed rollers 27*a*, 27*b*.

As is apparent from the foregoing explanation, the following effects are attained according to the present invention.

First, the continuous paper sheet can be torn correctly and precisely at the desired position of the sheet, because the width of the sheet in the folded continuous sheet is measured and respective pairs of the upper and the lower feeding rollers and of the upper and the lower high speed rollers move in the vertical direction toward and away from each other on the basis of the measurement result.

Second, the continuous paper sheet can be precisely torn from the desired position, because the vertical gaps between the pairs of the upper and the lower feeding rollers and of the upper and the lower high speed rollers are controlled according to the sheet thickness.

Third, the continuous paper sheet can be always and precisely torn from the desired position even though an error is generated in the sheet measurement, because the sheet tearing-off position on the sheet to be torn by respective pairs of upper and lower feeding rollers and the upper and lower high speed rollers is determined and set according to the result which is obtained by measuring the length of the sheets in the continuous paper sheet and correcting the measured length to the standard size.

Fourth, the size of the sheets in the continuous paper sheet can always be measured precisely and the paper sheet can always be torn correctly from the desired position without tearing it off from the wrong or erroneous position, because a detecting mechanism confirms that the continuous sheet is placed on the placement stand at the predetermined position when the size of the sheets in the continuous paper sheet is measured.

Fifth, because when the feeding portion having a sheet transfer function is used in the continuous paper sheet tearing-off apparatus, the sheet tearing-off position is set by causing the upper and lower high speed rollers to mutually approach according to the length transferred and the size of the paper sheet to be torn off and the sheet edge detection signal, the continuous paper sheet is correctly torn from the desired position. And because the feeding portion has a transfer function, no error due to the difference in the length transferred by the feeding portion and another transfer device is generated and it becomes possible to always correctly tear the sheet off from the desired position. Further because a particular or different transfer device need not be provided, the construction of the continuous paper sheet treating apparatus is simplified and made more compact.

What is claimed is:

1. A continuous paper sheet tearing-off apparatus for tearing off unit sheets from a continuous sheet having unit sheets separated by perforation lines transversely of the continuous sheet and in which the continuous sheet is in a zig-zag form constituting a stack of unit sheets, said apparatus comprising:

a pair of feeding rollers constituted by an upper rotatable feeding roller and a lower rotatable feeding roller;

a pair of high speed rollers constituted by an upper high speed roller and a lower high speed roller, said pair of high speed rollers spaced in a paper feed direction from said pair of feeding rollers, the rollers in said pairs being relatively movable toward and away from each other in mutual separating and approaching directions transversely of said paper feed direction;

drive means for driving said feeding rollers and said high speed rollers and driving said high speed rollers at a speed greater than said feeding rollers;

a blade positioned between said pairs of feeding rollers and high speed rollers;

a stand for supporting the stack of unit sheets in the continuous sheet and including means for measuring at least the length of the unit sheets in said continuous sheet and a position detecting means for detecting when said stack is properly positioned on said stand in a predetermined position, said position detecting means being connected to said measuring means for causing said measuring means to measure the length of the unit sheets only after it has been determined that the stack is properly positioned on said stand;

roller gap adjusting means connected to said pairs of rollers for moving the rollers of the respective pairs of rollers relatively toward and away from each other; and control means connected to said roller gap adjusting means and to said blade for controlling the timing of the operation of said roller gap adjusting means and said blade in response to the length of the unit sheet as measured by said measuring means for causing said pairs of rollers and said blade to engage the continuous sheet being fed therethrough to apply a tension to the continuous sheet between said pairs of rollers at the instant said blade is engaged with the continuous sheet at a perforation line between unit sheets.

2. A continuous paper sheet tearing-off apparatus for tearing off unit sheets from a continuous sheet having unit sheets separated by perforation lines transversely of the continuous sheet and in which the continuous sheet is in a zig-zag form with the unit sheets in a stack, said apparatus comprising:

a pair of feeding rollers constituted by an upper rotatable feeding roller and a lower rotatable feeding roller;

a pair of high speed rollers constituted by an upper high speed roller and a lower high speed roller, said pair of high speed rollers spaced in a paper feed direction from said pair of feeding rollers, the rollers in said pairs being relatively movable toward and away from each other in mutual separating and approaching directions transversely of said paper feed direction;

drive means for driving said feeding rollers and said high speed rollers and driving said high speed rollers at a speed greater than said feeding rollers;

a blade positioned between said pairs of feeding rollers and high speed rollers;

continuous sheet feed means on one of the rollers of said pair of feeding rollers and including a plurality of transfer rollers, a pair of mounting means on which said transfer rollers are mounted and supporting said transfer rollers between said pair of feeding rollers and including biasing means for biasing said transfer rollers toward one of said feeding rollers for nipping the continuous sheet between said transfer rollers and said one feeding roller when said feeding rollers are spaced apart, whereby the continuous sheet can be fed by the rotation of the other feeding roller, said mounting means being movable against the action of said biasing means for being moved to permit said feeding rollers to engage each other when said continuous sheet is to be torn;

roller gap adjusting means connected to said pairs of rollers for moving individual rollers of the respective pairs of rollers relatively toward and away from each other; and control means connected to said roller gap adjusting means, and to said blade for controlling the timing of the operation of said roller gap adjusting means and said blade in response to a size of the unit sheet inputted into said control means for causing said pairs of rollers and said blade to engage the continuous sheet being fed therethrough to apply a tension to the continuous sheet between said pairs of rollers at the instant said blade is engaged with the continuous sheet at a perforation line between unit sheets.

3. A continuous paper sheet tearing-off apparatus for tearing off unit sheets from a continuous sheet having unit sheets separated by perforation lines transversely of the continuous sheet and in which the continuous sheet is in a zig-zag form with the unit sheets in a stack, said apparatus comprising:

a pair of feeding rollers constituted by an upper rotatable feeding roller and a lower rotatable feeding roller;

a pair of high speed rollers constituted by an upper high speed roller and a lower high speed roller, said pair of high speed rollers spaced in a paper feed direction from said pair of feeding rollers, the rollers in said pairs being relatively movable toward and away from each other in mutual separating and approaching directions transversely of said paper feed direction;

drive means for driving said feeding rollers and said high speed rollers and driving said high speed rollers at a speed greater than said feeding rollers;

a blade positioned between said pairs of feeding rollers and high speed rollers;

sheet thickness detecting means positioned along the paper feed direction for detecting the thickness of the continuous sheet and providing an output corresponding thereto;

roller gap adjusting means connected to said pairs of rollers for moving individual rollers of the respective pairs of rollers relatively toward and away from each other; and control means connected to said roller gap adjusting means, to said sheet thickness detecting means and to said blade for controlling the timing of the operation of said roller gap adjusting means and said blade in response to the length of a unit sheet for causing said pairs of rollers and said blade to engage the continuous sheet being fed therethrough to apply a tension to the continuous sheet between said pairs of rollers at the instant said blade is engaged with the continuous sheet at a perforation line between unit sheets, and for relatively moving the rollers of said pairs of rollers toward each other by an amount to make a gap therebetween correspond to the detected thickness of the continuous sheet.

* * * * *